United States Patent [19]

Scott

[11] Patent Number: 4,817,227

[45] Date of Patent: Apr. 4, 1989

[54] BODY SCRUBBER

[76] Inventor: John H. Scott, 5054 Maple Dr., St. Louis, Mo. 63113

[21] Appl. No.: 60,644

[22] Filed: Jun. 11, 1987

[51] Int. Cl.[4] ..... A47K 7/04

[52] U.S. Cl. ..... 15/21 R; 15/21 E; 128/62 R

[58] Field of Search ..... 15/21 R, 21 C, 21 D, 15/21 E, 99 R; 128/56, 62 R; 4/606

[56] References Cited

U.S. PATENT DOCUMENTS

| | | | |
|---|---|---|---|
| 398,731 | 2/1889 | James | 128/62 R |
| 992,905 | 5/1911 | Robinson | 15/21 E |
| 1,609,796 | 12/1926 | Cheney | 128/56 |
| 1,712,521 | 5/1929 | Rothchild et al. | 128/62 R |
| 3,078,484 | 2/1962 | Briggs | 15/21 R |
| 4,356,583 | 11/1982 | Wallasch | 15/21 E |
| 4,490,871 | 1/1985 | Martin | 15/21 R |
| 4,633,857 | 1/1987 | Czeczerski | 15/21 R |

*Primary Examiner*—Harvey C. Hornsby
*Assistant Examiner*—Christine Peterson
*Attorney, Agent, or Firm*—Kalish & Gilster

[57] ABSTRACT

A user-powered body scrubber for use in a tub or shower. It includes at least one elongated vertical guide member, and brackets for mounting the guide member outwardly from the wall in spaced, parallel relation to the wall. A brush carriage is fitted to the vertical member in slidably captive relation for movement vertically along the guide member. At least one circular brush is carried by the brush carriage for rotation about an axis perpendicular to such movement along the guide member. A friction roller or rack-and-pinion arrangement causes the brush to rotate in response to said movement along the guide member. A cable has one end connected to the carriage, there being a first cable reach extending upwardly from the carriage along the guide member to a horizontal swingable arm including pulleys, the cable extending over the pulleys to provide a downwardly extending cable reach with a handle for being pulled by the user to lift the carriage upwardly along the guide member and for being released to permit the carriage to move downwardly along the guide member. The user places the body against the rotating brush while alternately pulling and releasing the cable to cause the brush to oscillate vertically as well as to oscillate rotatingly accordingly.

11 Claims, 5 Drawing Sheets

BODY SCRUBBER

This invention relates to tubs and showers and bath accessories in general, and more particularly, to apparatus for facilitating scrubbing of the body while bathing, as by tub or by shower.

Some persons find it difficult to reach portions of the body while bathing, and this is especially so when showering erect. For example, persons with arthritis or orthopedic limitations find it difficult to reach the lower extremities and the back.

The concept of back scrubbers goes back quite far in patented history, as evidenced by the 1988 U.S. Pat. No. 391,325 to Mayer. Patented efforts of twentieth century inventors are more sophisticated, and generally may be characterized as inventions having either user-powered or externally-powered mechanisms for moving a brush, sponge or other scrubbing element over the user's body. Thus, Tebo U.S. Pat. No. 1,488,076 teaches a scrubber having a brush which can be pulled by a cord passing over a cable for raising the brush. As the user pulls or releases a handle, the cord raises and lowers the brush.

Briggs U.S. Pat. No. 3,078,484 discloses a back scrubbing device which is permitted to slide on a rack until it is in a position desired by the user, at which point it becomes fixed by pins anchoring it in position. A brush of the device is rotated by a spring motor.

Greer U.S Pat. No. 3,085,269 reveals a rotary shower brush which is caused to turn by a so-called water turbine unit, whereas Wurn et al U.S. Pat. No. 3,875,604 describes a back scrubber which, while being caused to rotate by water power, has a horizontal brush which can be positioned at a desired height along a pipe. Wallasch et al U.S. Pat. No. 4,356,583 improved upon that concept not only by having a horizontal brush but also by providing a rack-and-pinion arrangement so that, in response to a water-driven cylinder, the brush can be caused to travel up and down.

In general, these prior arrangements have been needlessly complicated, as well as difficult and uneconomical to produce. Further they have generally been cumbersome or awkward to use. What is needed is a body scrubber which is inherently straightforward and economical in construction, so that it can be produced economically by mass production methods, and which is effective and easy to use.

Accordingly, among the several objects of the invention may be noted the provision of a body scrubber which is simple and uncomplicated in construction, being simple and economical to produce by virtue of being straight forward in construction, permitting it to be produced by mass-production methods in an economical manner; which is user-powered, permitting the user conveniently to scrub the lower extremities, such as the legs and other regions of the body which normally might be difficult to reach for persons with arthritis or orthopedic limitations, being usable even for a person of rather limited mobility or strength; which is effective in use so as to provide not only efficient cleaning over regions of the body, but also being stimulating and refreshing for the user; which does not require the services of a plumber, carpenter or other highly skilled tradesman for installation, but instead, can be installed in a facile convenient manner even by a mechanically unskilled user; and which is attractive and modern in appearance so as not to detract from the shower or bath in which it is installed.

Other objects and features will be in part apparent and in part pointed out hereinbelow.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 2:
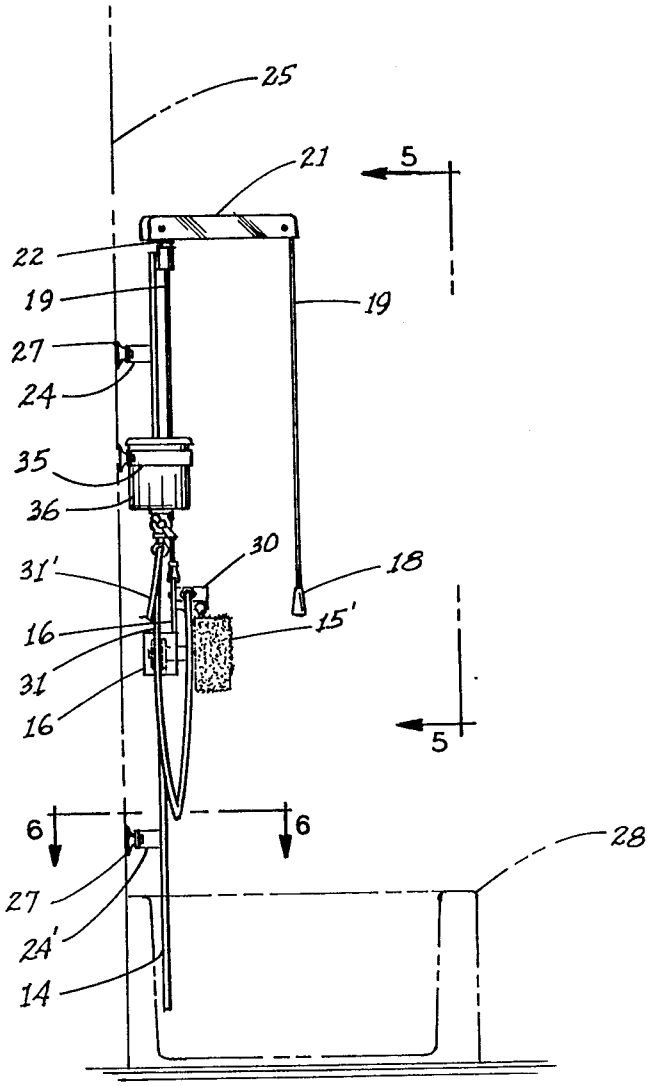
FIG. 2 is a side elevation view of the body scrubber, as taken generally along line 2—2 of FIG. 1.
Figure 1:
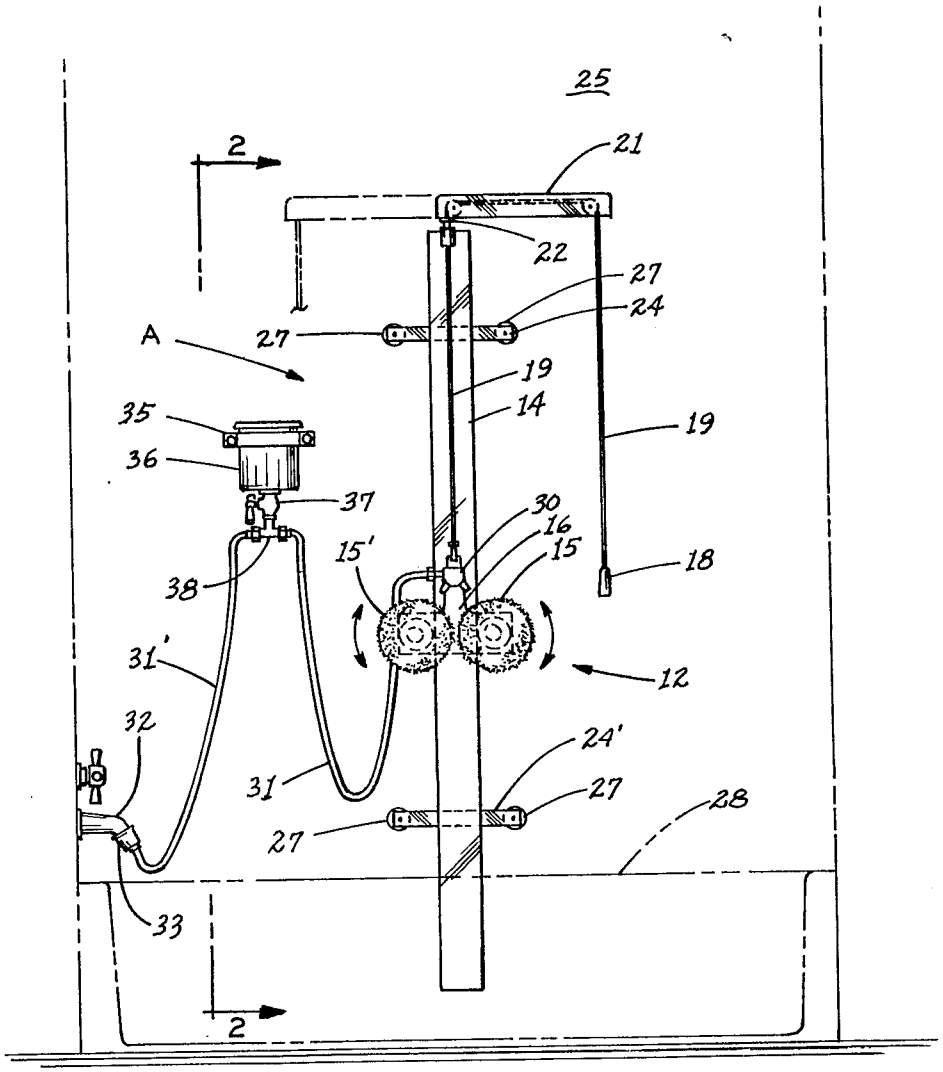
FIG. 1 is a front elevation view of a body scrubber in accordance with and embodying the present invention, as installed in a tub alcove or enclosure so as to extend into the tub, by being fixed to a wall along the tub.

Referring now to FIGS. 1 and 2, designated generally by reference character A is a first version of a body scrubber of invention, as configured to provide an elongated upright, vertical member 14 for presenting a pair of circular rotatable brushes 15, 15' movably supported by a carriage 16 attached to member 14, which carriage can be raised along guide member 14 in response to the pulling of a handle 18 at the end of a cord or cable 19. Cable 19 extends from a swing arm 21 pivotally connected at its proximal end, as at 22, to the upper end of guide member 14. Upper and lower brackets 24, 24', carried by member 14, secure member 14 to a wall 25, as by means of suction cups 27. Wall 25 can be any adjacent wall surface, such as that of a room, or of a shower or tub enclosure or surround. The brackets space vertical member outwardly from the wall in a spaced, parallel relation. In the preferred manner of installation when used with a tub, the lower end of member 14 extends into the tub, as designated at 28 with its lower end terminating proximate or at the tub floor.

The body scrubber is configured with a spray nozzle assembly 30 which is connected by lengths 31, 31' of flexible tubing to the usual faucet 32. Such connection is made by means of a rubber boot 33 shaped for fitting tightly over the end of the faucet. Mounted on wall 25 by means of a bracket 35 is a fluid reservoir 36 having a valve 37 at its lower end connected by a tee 38 to inner ends of the flexible lines 31, 31' so that as water flows from faucet 32 through the lines, fluid in the reservoir 36 will be entrained in the water. Reservoir 36 may be used for holding a quantity of body lotion, detergent, shampoo, bath salts, and so forth, so that water flow from faucet 32 will cause the liquid substance in reservoir 36 to be discharged with the water by the nozzle assembly. The nozzle assembly is located for causing the water and any such fluid entrained, to be sprayed on the brushes 15, 15' for body application.

Apparatus of the invention is completely user powered. Brush carriage 16 is raised along member 14 by pulling down of handle 18, and is permitted to fall by gravity when handle 18 is lifted or released. Guide member 14, being of uniform width and thickness along the length, serves as a guide rail for brush carriage 16, which extends at least partially around member 14 in slidably captive relation for vertical movement. Such movement of carriage 16 vertically along member 14 causes rotation of brushes 15, 15' in opposite directions for scrubbing of the user's body. Most preferably, the height of the upper end of member 14 is preferably at least as great as a normally-sized adult so that, at its highest position, carriage 16 will present said brushes 15, 15' for rotationally scrubbing the neck, upper back and other upper body portions, but when lowered to the position near the lower end of member 14, the brushes 15,15' can scrub the feet or legs. Further, swing arm 21 is preferably at least slightly above the head of any normally-sized adult.

The pivotal securement 22 of swing am 21 permits the arm to be deployed in any of a variety of positions as may suit the needs and convenience of the user, permitting it to be raised by either hand, and permitting also the user to rotate the body for scrubbing various parts while continuing to grasp the handle 18 with the same hand.

Figure 3:
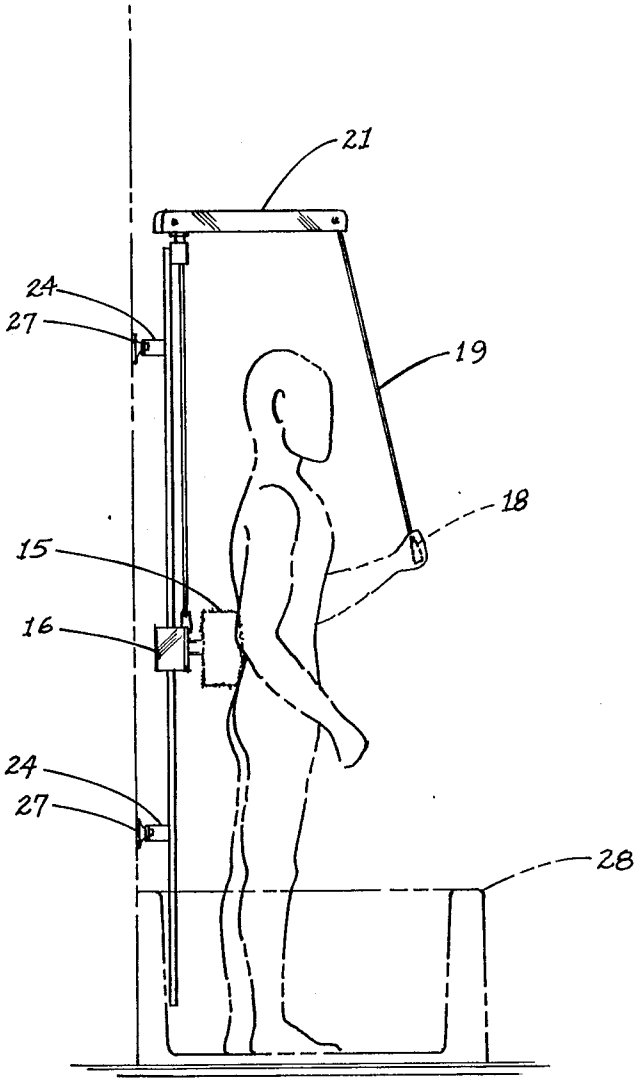
FIG. 3 is a similar side elevation view, illustrating the movement and positioning of one embodiment of the new body scrubber in use and illustrating the manner of usage.

FIG. 3 illustrates the method of usage wherein the user stands in a tub or shower enclosure with said handle 18 in hand and places the body lightly against the brushes 15,15'. Then, by alternately pulling cable 19 and permitting it to retract, carriage 16 will travel up and down vertical number 14 with oscillating movement, causing brushes 15,15' to rotate oscillatingly in opposite directions on axes which are perpendicular to the direction of vertical movement of carriage 16 along member 14. Water supplied by faucet 32 is directed by nozzle assembly 30 on the rotating brushes, and the user may open and shut valve 37 to control application of liquid soap, shampoo, body lotion or other substances as water flows onto the brushes.

Figure 5:
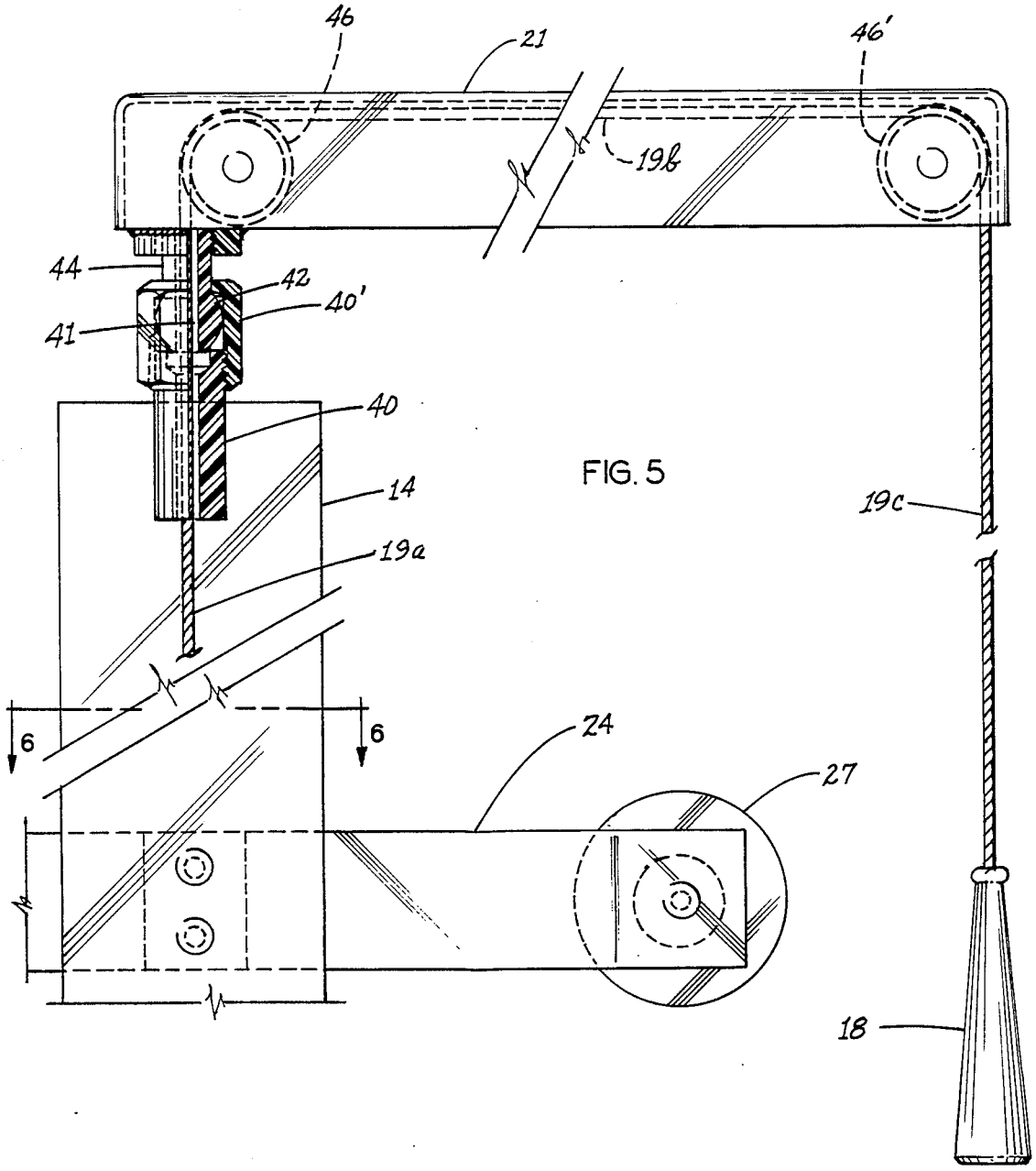
FIG. 5 is a enlarged detail view, as taken along line 5—5 of FIG. 2, of a portion of the body scrubber configuration shown in FIG. 2, as partially sectioned to show certain swing-arm features and also to show a certain brush carrier assembly.

FIGS. 5–8 illustrate the features of embodiment A shown in FIGS. 1 and 2. Referring to FIG. 5, vertical support 14 carries at its upper end a tubular extension 40, including a threaded fitting 40' in which is captive a spherical bearing 42. Like extension 40, the bearing is provided with a central bore 41 through which a first reach 19*a* of the cable passes, but permitting rotation of bearing 42 relative to extension 40. Bearing 42 is carried at the outer end of a tubular extension 44 similarly affixed to arm 21 which is of hollow construction to provide for passage through it of a second cable reach 19*b*, the arm having at its outer ends rollers 46, 46' over which the cable passes to provide an outer, vertical reach 19*c* terminating with handle 18. Arm 21 and also member 14 as well as the various fixtures hereinabove enumerated for pivotal rotation of arm 21 may be formed of suitable synthetic resin materials such as ABS.

Vertical member 14 although of uniform thickness, is provided with narrow recesses 48, 48'(FIG. 6) at its opposite side edges which provide for engagement of rolling drive means to be explained shortly.

Figure 6:
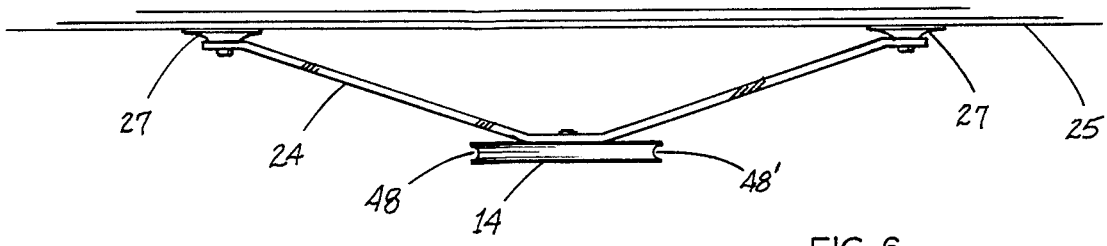
FIG. 6 is a horizontal cross section as taken along line 6—6 of FIG. 5, but to a slightly reduced scale.

The bracket members, such as that illustrated at 24 in FIG. 6, are affixed suitably to the rear of vertical number 14, and extend in diverging relation toward wall 25, carrying at their outer ends said suction cups 27. However, other mounting expedients can be used, including the direct screwing or bolting of brackets 24 to the wall.

Figure 7:
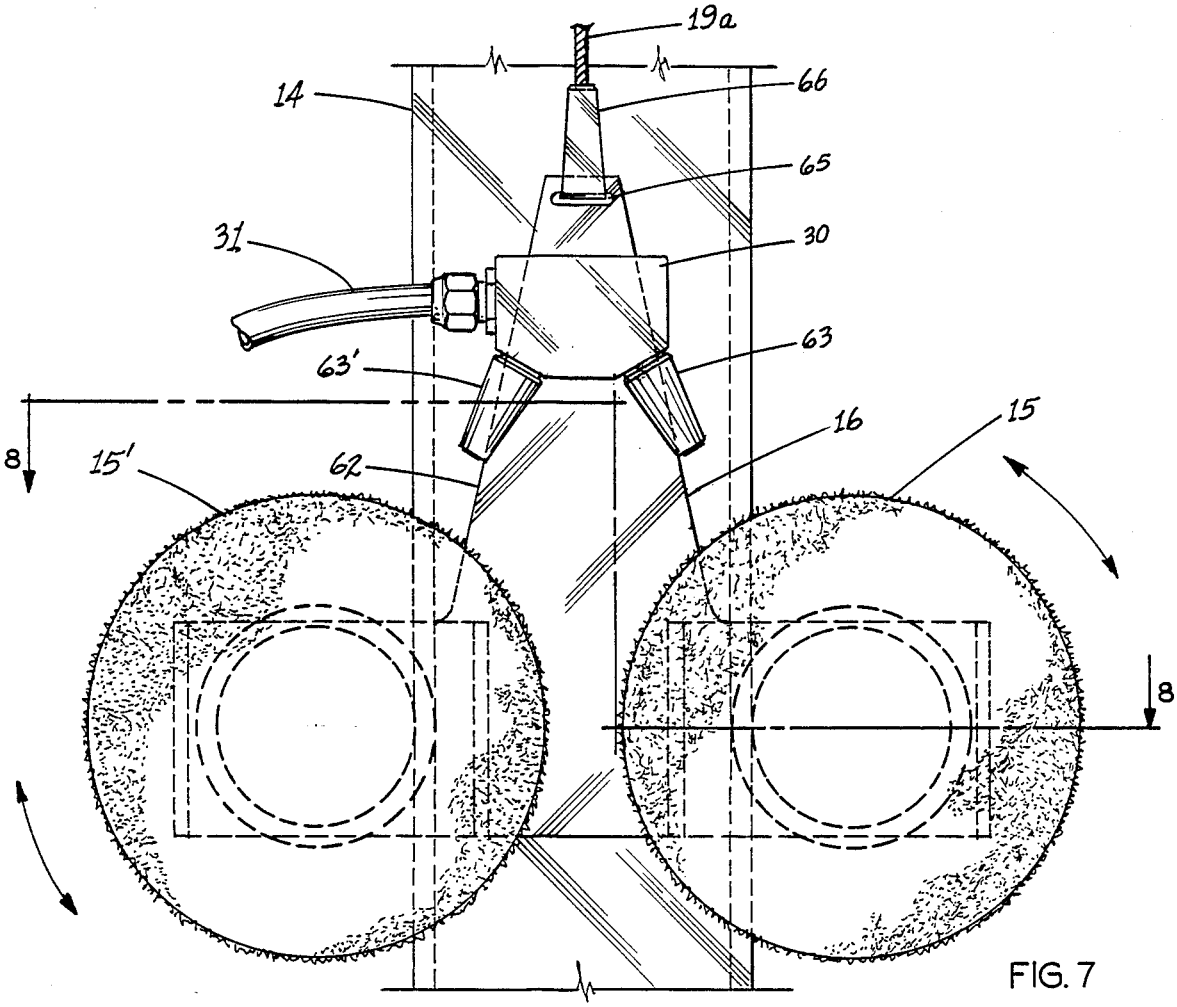
FIG. 7 is a partial front elevation view of certain brush and brush carrier details of the embodiment of FIG. 1.
Figure 8:
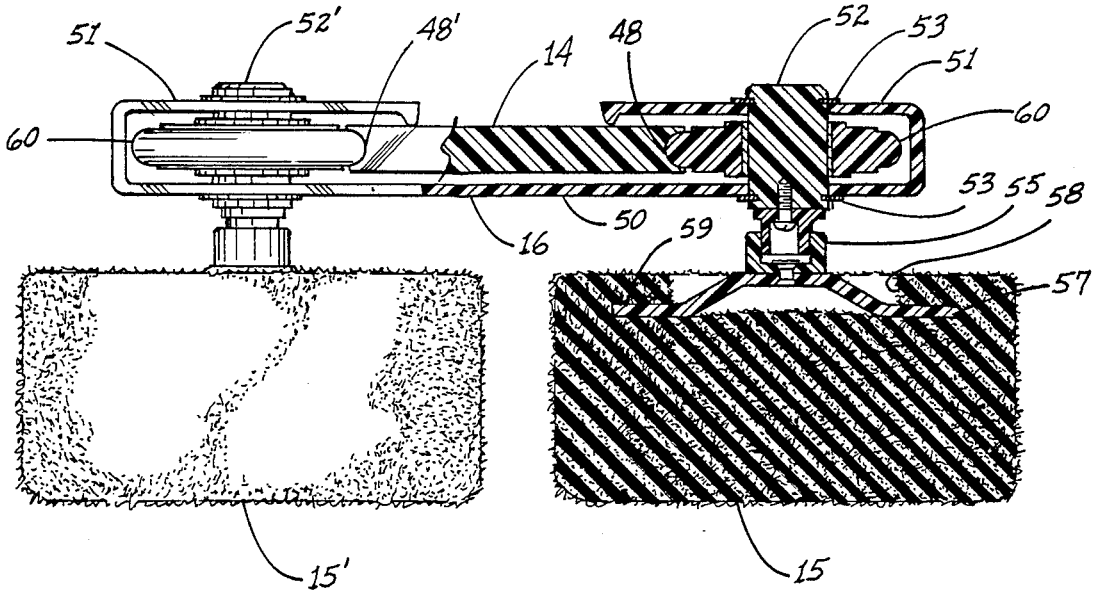
FIG. 8 is a horizontal cross section as taken generally along line 8—8 of FIG. 7.

Referring to FIGS. 7 and 8, carriage 16 is seen to comprise a front panel 50 which extends across and around the side edges of verticle number 14 in generally U-shaped configuration at its outer edges to provide rearward return flanges 51, 51'. Spindles 52, 52', i.e., axles for rollers, extend through the front panel 50 and into the rear flanges 51, being thus horizontally journalled and retained as by snap rings 53,53' for rotation. The spindles each carry at their outer ends a hub 55 including a radial flange 57 upon which the respective brush is mounted. For that purpose, each of said brushes may be provided with a rear opening 58, as shown, which opens into radial recesses as at 59 by receiving the radial flange.

The brushes themselves may be formed of several possible kinds of different soft, porous, fleecy or other resilient materials such as has been used before for cleaning purposes, including various natural sponge materials, synthetic sponge, knitted materials, woven materials, and natural or artificial fleece. Preferably, the thickness of these two brushes 15, 15' is such that substantial cushioning material is presented between each of the securement flanges 57 and the outer surface, against which the body will touch, so that there is a soft cushioning to permit free rotation without causing the underlying support structure to be felt by the user.

Keyed or otherwise secured to each such spindle 52, 52' is a respective roller 60,60', each roller periphery having a configuration for fitting complementarily within the respective groove 48, 48' along vertical member 14. The rollers 60, 60' may be of rubber or synthetic or natural material, elastic or semi-elastic, for frictional engagement with the vertical member, such that by pulling or releasing handle 18, each of the rollers will be caused to roll with such movement to provide rotation of the brushes 15, 15'.

Referring to FIG. 7, carrier 16 includes a central, upwardly directed extension 62 which carries said nozzle assembly 30. This assembly includes a pair of nozzles 63, 63' for directing the water delivered by line 31 to the respective brushes 15, 15'. Extension 62 also includes an aperture 65 at its upper extremity through which a fitting 66 connected to the end of cable 19. Cable 19 may be of any of various suitable materials, including nylon, polyester, stainless steel, and so forth, such as to be rendered strong, light-weight and long-lasting. Carrier 16, as for other components of the apparatus, may be molded of synthetic resin material such as ABS, or may as well be formed of cast metal such as aluminum, or instead may be of sheet metal.

Figure 4:
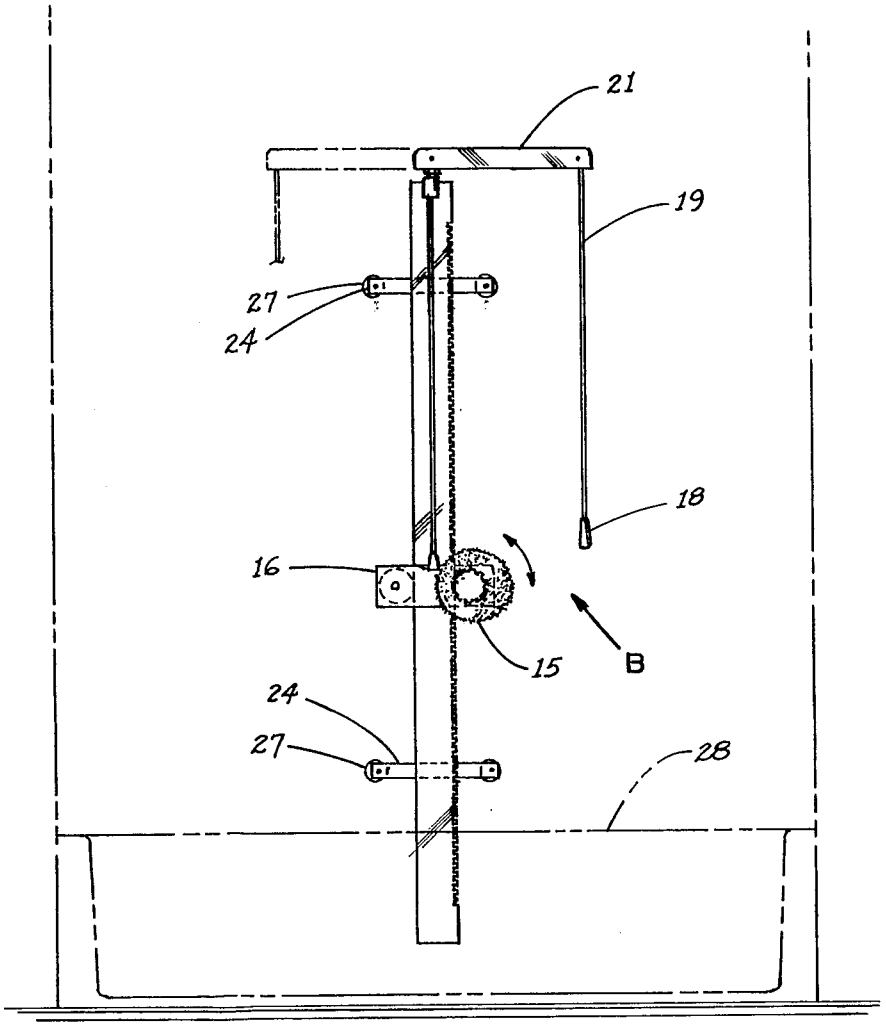
FIG. 4 is a front elevation view of a further embodiment of the new body scrubber.
Figure 9:
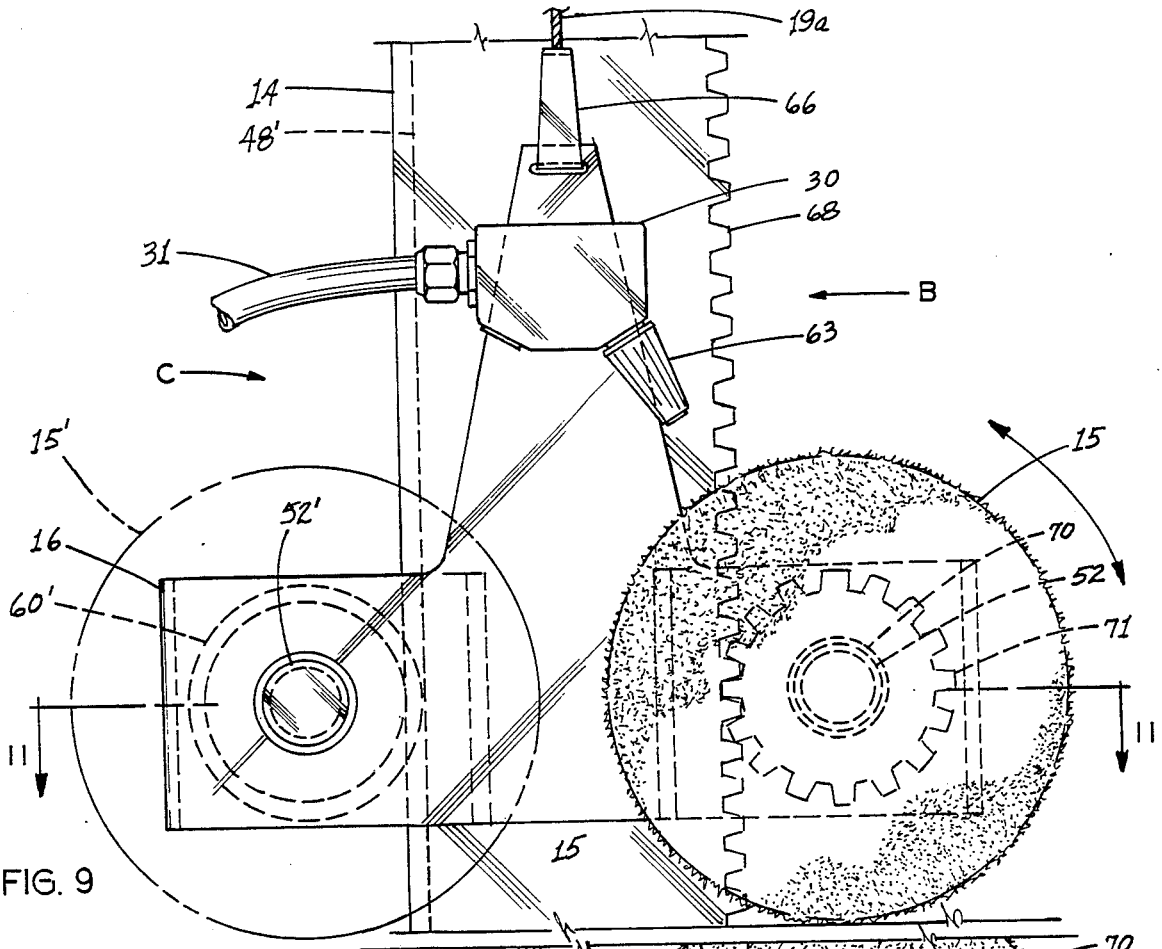
FIG. 9 is a partial elevation view similar to FIG. 7, but illustrating features of the unit of FIG. 4.

Referring now to FIG. 4, a modified embodiment B of the invention is provided with said vertical member 14 having gear teeth 68 formed along a side edge thereof, the other side being formed as before with a recess 48' (FIG. 9). Further, this embodiment is configured for presenting a single brush 15 carried by brush carrier 16, which carrier may be pulled up and down by the user by manipulation of handle 18 by the cable or line 19 suspended from arm 21, which pivots as in the previous arrangement.

Referring to FIG. 9, there is illustrated a further embodiment C of the invention. Carrier 16 is provided with a front panel 50 through which the shaft 52 extends as in the above-described configuration for embodiment A but with there being no extension of the shaft 52' for roller 60' which now acts as an idler roller for positioning the carrier 16 relative to vertical member 14. As cable 19 causes the carrier to move up or down along number 14, roller 60' rolls in groove 48'. Shaft 52 carries, instead of a roller, a pin 70 having teeth 71 for meshing with teeth 68. Thus, in effect, vertical member 14 provides a rack gear for rack-and-pinion driving of shaft 52 to rotate brush 15. Further, in this embodiment, spray assembly 30 is configured to provide a single nozzle 63 for spray of water upon brush 15.

Figure 10:
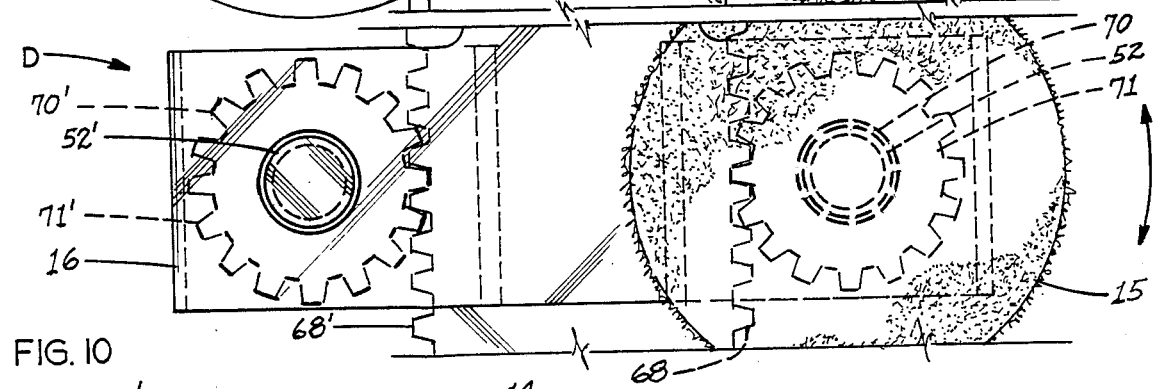
FIG. 10 is a similar partial front elevation view, but showing portions of a modified embodiment having a different brush driving mechanism.

The modified version is illustrated in FIG. 10 is an embodiment D having a second pinion 70' and with the opposite side edge of vertical member being similarly provided with teeth 68' for meshing engagement with corresponding teeth 71' of pinion 70. Pinion 70' is an idler pinion replacing the function of roller 65, but shaft 52' may instead be configured for carrying and driving a second brush as in embodiment A.

Figure 11:
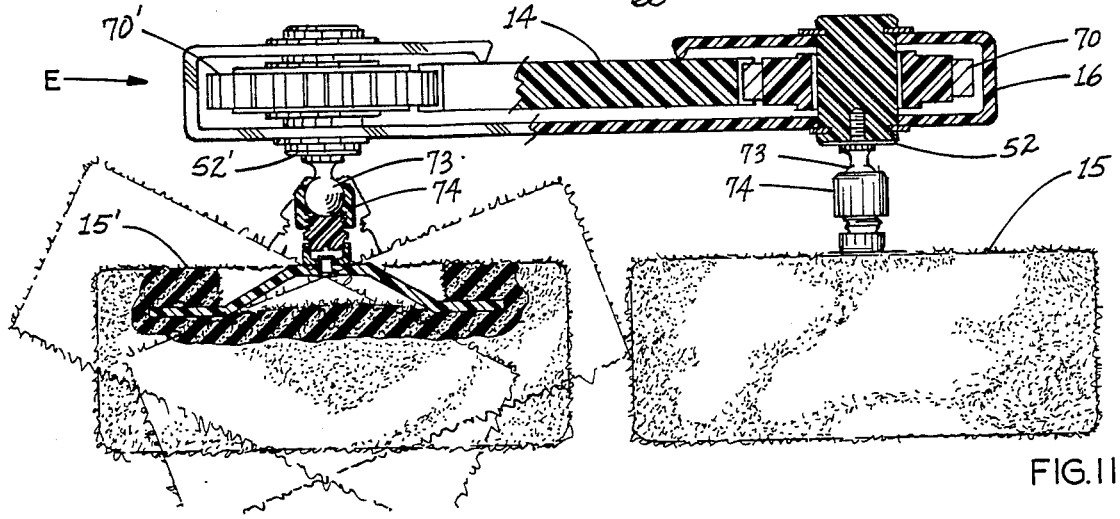
FIG. 11 is a partial cross section of the brush and brush carrier apparatus depicted in FIG. 9, as taken generally along line 11—11 thereof.

In FIG. 11, a still further embodiment E is illustrated. It includes pinions 70, 70' for driving respective rollers which is carried by a respective shaft 52, 52' in such manner as to permit the brush to pivot as shown in response to body contact. For this purpose, each said shaft, as for example shaft 52, is provided with a splined ball coupling 73 which is engaged by splined fitting 74 whereby the brush is drivingly rotated by the shaft but is free to pivot about the center of ball 73 as depicted, so that the brush is able to rotate on an axis skewed relative to that of shaft 52. This allows the brush of this embodiment to more readily follow body contours.

Thus, there is seen to be provided a user-powered body scrubber for use in a tub or shower, comprising at least one vertically elongated guide means, i.e., a guide member, means for mounting the guide member outwardly from the wall in spaced, parallel relation to the wall, and a brush carriage fitted to the guide member in slidably captive relation for movement vertically along the guide member. At least one circular brush is carried by the brush carriage for rotation about an axis perpendicular to said movement along the guide member. Means is provided for causing the brush to rotate in response to such movement along the guide member. A cable has one end connected to the carriage, there being a first reach of the cable extending upwardly from the carriage along the guide member. The cable extends over at least one pulley to provide a further downwardly extending reach of the cable for being pulled downwardly by the user to lift the carriage upwardly along the guide member and for being released to permit the carriage to move downwardly along the guide member. Accordingly the user may scrub the body by placement of the body against the rotating brush while alternately pulling and releasing the cable outer reach.

In view of the foregoing, it will be seen that the several objects of the invention are achieved and other advantages are attained.

Although the foregoing includes a description of the best mode contemplated for carrying out the invention, various modifications are contemplated. For example, the single vertical support member could be replaced by parallel vertical members which together serve as guide means for the brush carrier, and the number of brushes may be greater than two.

As various modifications could thus be made in the constructions herein described and illustrated without departing from the scope of the invention, it is intended that all matter contained in the foregoing description or shown in the accompanying drawings shall be interpreted as illustrative rather than limiting.

What is claimed is:

1. A user-powered gravity-assisted body scrubber for use in a tub or shower, comprising a vertically elongated guide member of uniform width, and an arm swingably attached to an inner end of the arm to an upper end of the guide member and extending radially outwardly therefrom, means pivotally affixing the inner end of the arm to said upper end of the guide member and permitting the arm to be deployed in any of a variety of positions determined by the user, means for mounting the guide member outwardly from the wall in spaced, parallel relation to the wall, a brush carriage fitted to the guide member in slidably captive relation for movement vertically along the guide member, at least one circular brush carried by the brush carriage for rotation about an axis perpendicular to said movement along the guide member, means for causing the brush to rotate in response to said movement along the guide member, a cable having one end connected to the carriage, a first reach of the cable extending upwardly from the carriage along the guide member, a second reach of the cable coincident with the arm, the arm guiding the second reach cable outwardly from the elongated member, at least one pulley carried by the arm, the cable extending over the pulley to provide at the outer end of the arm at a user-selected position, determined by user positioning of the arm, a downwardly extending third reach of the cable for being pulled downwardly by the user by use of either hand to lift to carriage upwardly along the guide member against gravity and for being released to permit the carriage to move downwardly under its own weight along the guide member assisted by the force of gravity, the guide member extending from at least proximate a floor of said tube or shower, and having an upper end at a height at least as great as the height of a normally sized adult whereby the user may scrub the body by placement of the body against the rotating brush while alternately pulling and releasing the cable outer reach by single-handed operation to produce thereby vertical oscillation of the brush and corresponding rotation of the brush.

2. A user-powered body scrubber according to claim 1 wherein the arm is horizontal and includes pulleys at its inner and outer ends, the cable first reach extending from the carriage to a first such pulley at the arm inner end, the second reach extending from the first pulley to a second pulley at the arm outer end, and the third reach extending vertically downwardly from the second pulley.

3. A user-powered body scrubber according to claim 1 wherein the brush is carried by a spindle horizontally journalled for rotation in the brush carriage, the drive means comprising a roller secured to the spindle for frictional engagement with a surface of the guide member.

4. A user-powered body scrubber according to claim 1 wherein the brush is carried by a spindle horizontally journalled for rotation in the brush carriage, the drive means comprising rack gear feet along at least part of the vertical length of the guide member and a pinion secured to the spindle for toothed engagement with the rack gear teeth.

5. A user-powered body scrubber according to claim 1 wherein said brush carrier carries spray nozzle means for directing a liquid spray onto said brush, and further comprising a liquid supply line for providing liquid to the nozzle means.

6. A user-powered body scrubber according to claim 5 further comprising a reservoir for containing liquid to be applied to the body by said brush, said liquid supply line connecting the reservoir to the nozzle means.

7. A user-powered body scrubber according to claim 6 the liquid supply line being connectable to a water source at one end to supply water for spray by said spray nozzle onto said brush and means selectively connecting said reservoir to liquid supply line for controlling entrainment of liquid from the reservoir into the water for spray by the spray nozzle onto the brush.

8. A user-powered body scrubber according to claim 1 wherein the brush is carried by a spindle horizontally journalled for rotation in the brush carriage, and coupling means carried by the spindle for permitting the brush to rotate about an axis skewed from the axis of rotation of the spindle.

9. A user powered gravity-assisted body scrubber for use in a tube or shower, comprising at least one elongated vertical guide member, means for mounting the guide member outwardly from a wall adjacent the tub or shower in spaced, parallel relation to the wall, said guide member comprising a single elongated member of uniform width, the guide member extending from at least proximate a floor of said tube or shower, and having an upper end at a height at least as great as the height of a normally sized adult, a brush carriage fitted to the guide member in slidably captive relation for movement vertically along at least a portion of the length of the guide member, at least one circular brush carried by the brush carriage for rotation about an axis perpendicular to said movement along the guide member, drive means providing rolling engagement with the guide member for causing the brush to rotate in response to said movement along the guide member, a cable having one end connected to the carriage, a first reach of the cable extending upwardly from the carriage along the guide member, and further comprising an arm swingably attached to an upper end of the guide member and extending radially outwardly therefrom, means pivotally affixing the inner end of the arm to said upper end of the guide member and permitting the arm to be deployed in any of a variety of positions determined by of the user, the arm guiding a second reach of the cable outwardly from the guide member to provide a third reach of the cable to a user-selected position, determined by user positioning of the arm, extending vertically downwardly from an outer end of the arm for being pulled downwardly by the user to lift the carriage upwardly along the guide member against gravity and for being released to permit the carriage to move downwardly under its own weight along the guide member assisted by the force of gravity, the brush carrier carrying spray nozzle means for directing a liquid spray onto said brush, and further comprising a liquid supply line for providing liquid to the spray nozzle means, whereby the user may scrub the body by placement of the body against the rotating brush while alternately pulling and releasing the cable outer reach by single-handed operation to produce thereby vertical oscillation of the brush and corresponding rotation of the brush.

10. A user-powered body scrubber according to claim 9 wherein the brush is carried by a spindle horizontally journalled for rotation in the brush carriage, the drive means comprising a roller secured to the spindle for frictional engagement with a surface of the guide member.

11. A user-powered body scrubber according to claim 9 wherein the brush is carried by a spindle horizontally journalled for rotation in the brush carriage, the drive means comprising rack gear teeth along at least part of the vertical length of the guide member and a pinion secured to the spindle for toothed engagement with the rack gear teeth.

* * * * *